United States Patent [19]

Brown

[11] 4,401,261

[45] Aug. 30, 1983

[54] FLUE GAS HEAT RECOVERY APPARATUS

[76] Inventor: LeeRoy W. Brown, 30245 Barbary Ct., Warren, Mich. 48093

[21] Appl. No.: 199,908

[22] Filed: Oct. 23, 1980

[51] Int. Cl.[3] ..... F23M 1/02

[52] U.S. Cl. ..... 236/10; 237/55; 237/19; 165/39; 165/DIG. 2; 122/20 B

[58] Field of Search ..... 237/8 R, 19, 16, 55; 165/DIG. 2, 39; 122/20 B; 236/10, 11, 49, 95, 96

[56] References Cited

U.S. PATENT DOCUMENTS

| | | | |
|---|---|---|---|
| 1,633,759 | 6/1927 | Breese, Jr. | 165/DIG. 2 |
| 1,941,496 | 1/1934 | Scyleh | 165/DIG. 2 |
| 2,237,054 | 4/1941 | Jensen | 126/101 |
| 2,482,746 | 9/1949 | Crozier | 237/16 |
| 3,726,473 | 4/1973 | Sapir | 236/11 |
| 4,066,210 | 1/1978 | Pemberton | 237/53 |
| 4,194,558 | 3/1980 | Goosman | 122/20 B |
| 4,210,102 | 7/1980 | Dosmann | 122/20 B |
| 4,258,878 | 3/1981 | Van Pachtenbeke | 165/DIG. 2 |

FOREIGN PATENT DOCUMENTS

| | | | |
|---|---|---|---|
| 1398854 | 6/1975 | United Kingdom | 165/DIG. 2 |

*Primary Examiner*—William R. Cline
*Assistant Examiner*—John F. McNally
*Attorney, Agent, or Firm*—Remy J. VanOphem

[57] ABSTRACT

A flue gas heat recovery apparatus is employed with a system of appliances such as a gas furnace and hot water heater, each having separate exhaust gas flues. The apparatus includes a gas-to-liquid heat exchanger in thermal communication with the two flues to simultaneously extract heat therefrom and a liquid-to-gas heat exchanger disposed within the furnace cold air return duct. A pump circulates water between the exchangers in response to a control signal to employ the recovered heat to preheat the cold air entering the furnace through the cold air return duct. A hysteretic control circuit monitors exhaust gas temperature and provides for system operation between high and low gas temperature limits. In the preferred embodiment of the invention, a furnace blower override feature is employed to energize the blower during periods of pump operation.

9 Claims, 1 Drawing Figure

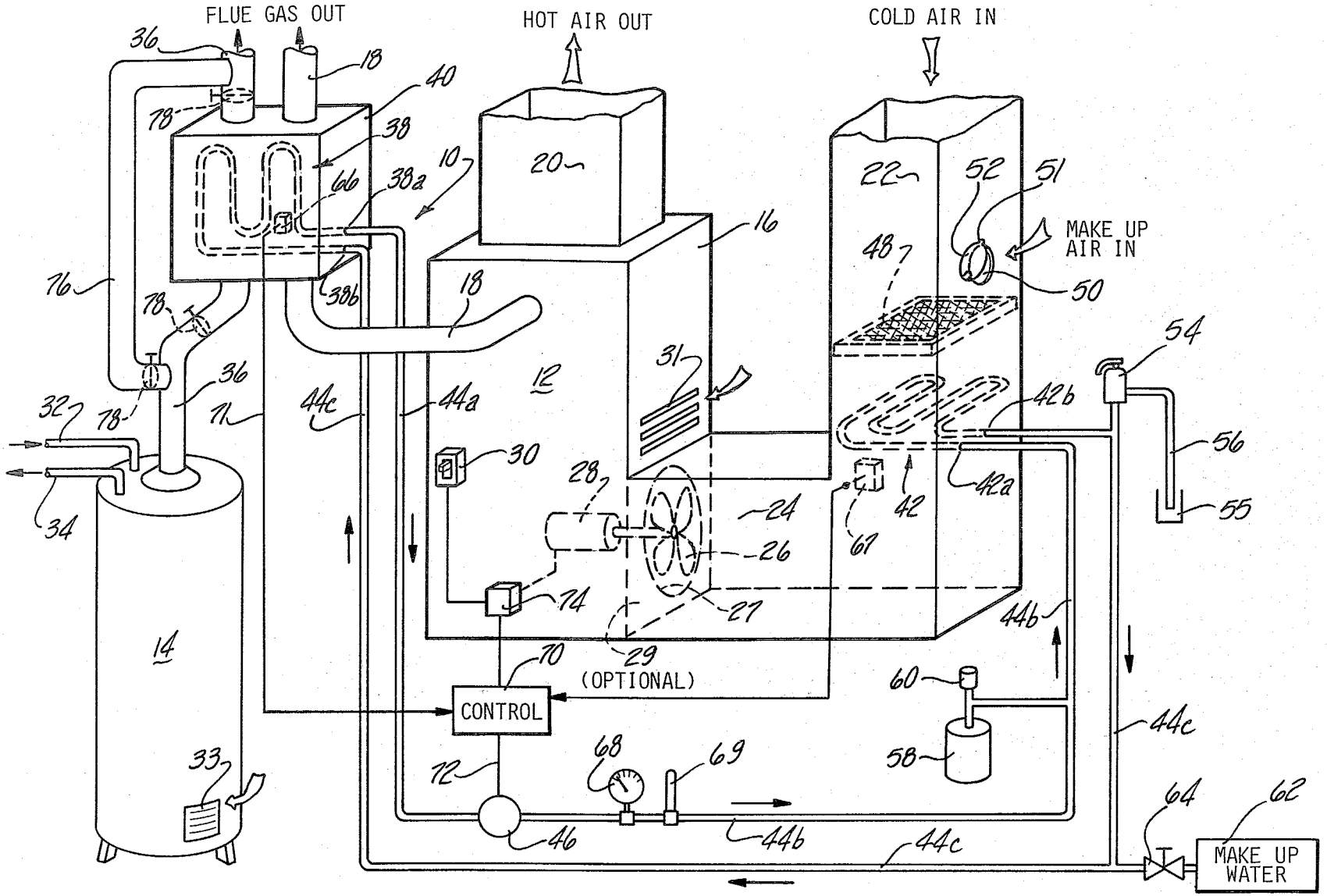
COLD AIR IN
HOT AIR OUT
FLUE GAS OUT
MAKE UP AIR IN
MAKE UP WATER
CONTROL
(OPTIONAL)

FLUE GAS HEAT RECOVERY APPARATUS

The present invention relates to heat transfer apparatus and more particularly to such apparatus which recovers flue gas exhaust heat and employs it to enhance operation of an associated appliance. More particularly still, the present invention relates to such apparatus which recovers flue gas heat from a plurality of appliances and applies it to enhance operation of one of the appliances.

BACKGROUND OF THE INVENTION

A well recognized shortcoming of most home heating systems is their relatively low level of efficiency. Furnaces which burn combustible mixtures, particularly hydrocarbon fuels and atmosphere oxygen, require exhaust flues to externally vent the products of combustion to assure that carbon monoxide and other toxic gases do not accumulate in the home to present a health or safety hazard. Studies have indicated that a significant percentage of the heat from home furnaces is lost through the escape of hot flue gases up the chimney. Other home appliances, particularly hot water heaters, which are fueled by combustible mixtures also lose substantial amounts of thermal energy in the venting of hot exhaust gases.

One prior art approach has been to install thermally actuated valves or dampers within the flues which are carefully calibrated to open at a relatively high temperature which is achieved only when the furnace is in actual operation. Such valves open to allow normal aspiration while the furnace is running and partially close to restrict exhaust gas flow when the furnace is off. Even in the off mode, however, flue dampers must remain open a sufficient amount to permit escape of exhaust gas generated by the furnace pilot light, and therefore, provide a thermal leak. Such devices have been only partially successful in the marketplace inasmuch as they could present a safety hazard under some failure modes. Additionally, and more importantly, such devices only operate to block or prevent the escape of heat during periods in which the furnace is not operating. This heat represents a relatively small portion of the total heat loss through the flue during the overall furnace duty cycle of operation.

Other prior art approaches to capturing some of the heat lost up the flue have suggested the application of heat exchangers, positioned within the flue, which circulate a heat absorbing liquid (water) therethrough. The heated water is then either returned directly to the hot water tank of the home as a supplement to normal hot water generation or is used in a hot water radiator to provide supplemental heat. Although such prior art systems are partially successful in capturing some of the otherwise lost heat of the furnace, they have been employed primarily in hot water heating systems as opposed to forced air heating systems and have been relatively complex and expensive, both in installation and maintenance.

A number of prior art devices employed in forced air type heating systems for building have also recognized the advantage of recovering heat from escaping hot flue gases, and have attempted to devise means for transferring a portion of the heat of the exhausted gas to the area intended to be heated. Such heating systems typically include a heating chamber or furnace provided with a warm air delivery duct and a cool air intake or return. A flue pipe for venting the gases and products of combustion is in communication with the heating chamber. The flue pipe, which normally includes a metallic, heat conducting material, passes through the cool air return duct so that the cool air returning to the heating chamber passes over warm surfaces of a short stretch of the flue pipe. The returning cool air is, in effect, slightly preheated prior to entering the heating chamber. In this manner, the temperature of the air within the heating chamber to be heated is slightly increased. Consequently, the energy required to elevate the temperature of the preheated return air to the desired temperature is reduced.

A system such as that described generally in the preceding paragraph is the subject of a recently issued United States Patent which discloses a heat recovery device which is installed within the cool air return duct of a heating system to transfer the ordinarily wasted heat in the exhaust gases flowing through the flue pipe to the cool return air, thereby preheating the latter and increasing the efficiency of the heating system. The details of the device are drawn toward a complex three stage heat transfer structure which is disposed within a heat conductive tubular member which cooperates to transfer heat away from the gases into the cool return air by means of conduction, convection and radiation processes. A first stage deflects a portion of the gases toward and into heat exchanging contact with the sidewalls of the tubular member and in the second stage directs the remaining portion into a gas pervious heat storage trap. The third stage includes a perforated, heat deflecting and radiating cone structure which cooperates with the first and second stages to produce temperature stratification within the tubular member to further increase heat transfer to the cool return air.

Although devices such as that disclosed above are partially effective to transfer heat to the cool return air duct, such systems have a number of shortcomings. The products of combustion being vented in the duct contain poisonous carbon monoxide as well as other toxic gases which, if somehow were able to leak into the fresh air return could conceivably be circulated through the house and present a hazardous condition. Additionally, air, being a relatively good insulator, is not the most effective fluid for application within high capacity heat exchangers. Finally, such devices are often passive inasmuch as they provide no control of the furnace blower and thus only recover heat when the blower is cycled on. When the furnace blower is not on and air is not passing through the cool air return duct, very little heat would be transferred.

U.S. Pat. No. 2,189,748 to Windheim et al represents another approach taken in prior art heat recovery apparatus. In Windheim, a water heater is installed in the flue of a furnace wherein waste heat is captured by heating the water which subsequently supplements the normal hot water system within the home. Such approaches have limited value inasmuch as the supplemental heat to the hot water system is not always present and thus, a constant hot water temperature within the home is difficult to maintain. Additionally, a rupture of a water heating pipe within the flue could cause the water supply to the home to be directly discharged into the furnace with potential catastrophic results.

Still another prior art approach is disclosed in U.S. Pat. No. 4,136,731 to DeBoer. DeBoer discloses a heat transfer system for use in supplementing the operation of the heating/cooling system of a building and its hot water heating system, which includes a heat exchanger in the flue of the furnace as well as a heat exchanger in the fan (furnace) chamber. A first liquid circulation loop couples the heat exchangers for transferring heat from the flue exchanger to the air moved through the fan chamber heat exchanger. A second liquid circulation loop includes the flue exchanger and the building hot water heater for supplementing the heating of water therein. In the summer months during the cooling mode of the system's operation, cold water employed, for example, for lawn sprinkling is passed through the fan chamber heat exchanger for cooling and dehumidifying air circulated in the building. A valve control system is employed to automatically control the flow path of fluid in the system as a function of detected temperatures.

Although the DeBoer device is partially automated and represents an advance in the art, such devices contain many of the shortcomings described herein above and do not address the common situation of a system of appliances having multiple flues or coordinate operation of the heat recovery apparatus with the overall operation of the furnace itself to maximize heat recovery.

Finding a heat recovery device which overcomes the above outlined problems and reduces dependence on hydrocarbon fuels has recently become more urgent in light of the precipitus increase in the cost of such fuels as well as their predicted shortages.

BRIEF DESCRIPTION OF THE INVENTION

The present invention relates to a flue gas heat recovery apparatus which overcomes many of the above described shortcomings of the prior art and is intended for use with a forced air type furnace of the type which utilizes and external exhaust flue, a blower adapted for circulating heated air through a duct system and a cold air return duct system. According to the present invention, the heat recovery apparatus includes first and second heat exchangers, the first (gas to liquid) heat exchanger associated with the exhaust flue to extract heat therefrom and the second (liquid to gas) exchanger disposed within the cold air return duct. The second heat exchanger receives circulating liquid via a pump in response to the generation of a control signal. The circulation of fluid between the heat exchangers effects a net heat transfer from the gas within the flue to the air within the cold air return. Finally, control means is provided which monitors the temperature of the exhaust gas and operates to generate the control signal as a function of the temperature and preselected temperature level limits. Alternatively, and/or additionally, the control means monitors the temperature of the air flow exiting the furnace and generates the control signal as a function thereof. This arrangement has the advantage of providing a very simple and effective heat recovery apparatus which recovers heat from the furnace flue and transfers it to the cold air return duct of the furnace through a closed, low volume secondary liquid loop. This arrangement also has the advantage of isolating the exhaust gases and household water system from the fresh air portion of the furnace ducting system.

According to the preferred embodiment of the invention, an override feature is provided which will take control of normal operation of the furnace blower during generation of the control signal. This arrangement has the advantage of maximizing heat transfer during periods in which the exhaust gas is elevated above a predetermined temperature, irrespective of furnace operation.

According to another aspect of the invention, the first heat exchanger is also in thermal communication with the exhaust gas flue of a hot water heater, and operates to absorb the exhaust heat therefrom. This arrangement has the advantage of providing a flue gas heat recovery apparatus which simultaneously extracts heat from two (or more) appliances for use in enhancing operation of one of the appliances (furnace).

According to another aspect of the invention, duct means are provided which are operable to selectively reconfigure the exhaust flue associated with the hot water heater described immediately herein above to bypass the first heat exchanger. This arrangement has the advantage of providing for convenient seasonal reconfiguration of the flue gas heat recovery apparatus while retaining relative structural simplicity.

According to still another aspect of the present invention, the control means operates to initiate generation of the control signal when the exhaust gas temperature substantially equals a high temperature set point, and continues generation of the control signal until the gas temperature substantially equals a low temperature set point. This arrangement has the advantage of providing a hysteretic on-off control function for the pump means to prevent a possible unstable condition (as could occur if the turn-on and turn-off temperature set points coincided).

These and other features and advantages of this invention will become apparent upon reading the following specification, which, along with the patent drawing, describes and discloses a preferred illustrative embodiment of the invention in detail.

The detailed description of the specific embodiment makes reference to the accompanying drawing which illustrates, in schematic form, the present invention and its interface with a typical household forced air furnace and hot water heater.

DETAILED DESCRIPTION OF THE PREFERRED EMBODIMENT

Referring to the drawing, the preferred embodiment of an inventive flue gas heat recovery apparatus (hereinafter referred to as "the system"), shown generally at 10, is illustrated in schematic form. The system 10 is contemplated for application with a conventional household type gas fired furnace 12 as well as a gas fired hot water heater 14. Although the principally intended application of the system 10 is with furnaces and hot water heaters which consume combustible mixtures of fossil fuels and atmospheric oxygen, it is contemplated that the present invention can be readily adapted to any such home system of appliances which have pilot lights and consume fossil fuels, e.g. gas clothes dryers with varying degrees of success. The Applicant has found that the present invention is most easily accommodated by natural gas fired appliances whose exhaust gases are relatively free of particulate matter. To best take advantage of the present invention, oil fired appliances may require additional apparatus to remove soot or other matter from the exhaust gases which could accumulate to degrade system operation and potentially create a hazardous condition. Likewise, the application of the present invention with a clothes dryer would necessitate the application of additional equipment to filter exhaust lint. Such apparatus and equipment is not considered to be within the scope of the present invention.

The furnace 12 includes an upwardly elongated cabinet 16 which houses a gas burner manifold (not illustrated) which is connected to a source of natural gas. A vent hood or bonnet (also not illustrated) is positioned over the manifold to collect the products of combustion including carbon monoxide and vent them externally of the house or structure associated with the furnace 12 through a hot gas exhaust flue 18. In most installations, the flue 18 interconnects the furnace hood with a chimney formed of masonry which is positioned above the hood whereby the flue 18 promotes natural thermal aspiration of the hot flue gases by mechanisms well known in the art. The burner manifold has a continuously burning pilot light associated therewith which also consumes fuel and generates exhaust gas which is vented via the exhaust flue 18. For the purposes of the ensuing description, exhaust gas generated by the pilot light is not differentiated from that generated during burner-on operation of the furnace 12.

The upper end of the cabinet 16 opens into a hot air duct system 20 which passes throughout the structure intended to be warmed by the furnace 12 for distribution of the hot air generated within the furnace 12. A cold air return duct system is connected to a cold air return duct 22 which extends downwardly to near floor level, communicating with the lower end of the cabinet 16 through an intermediate blower chamber 24. A furnace blower fan and motor 26 and 28, respectively, are positioned at an interface 29 between the blower chamber 24 and the cabinet 16, which defines an airflow directing aperture 27 therein which circumscribes the fan 26. The fan 26 operates, when energized, to draw cold return air into the cold air return duct 22, pass it into the cabinet 16 for heating and return it under pressure to the structure to be heated via the hot air duct 20. A switch, thermostat or other suitable control apparatus 30 operates to cycle the blower fan 26 by energizing the motor 28. This energization can occur manually or automatically by employing control apparatus such as thermostats which are well known in the art. The structural arrangement described herein is considered by the applicant to be of conventional design and is included only as an illustrative environment for the present invention. The fan 26, motor 28 and switch 30 are the units which would preexist in any similar installation.

The hot water heater 14 is likewise of conventional design having a first pipe 32 connected to a source of fresh potable water and a second pipe 34 connected to the household hot water distribution system. The hot water heater 14 has a gas burner manifold, pilot burner and hood (not illustrated) which, like the furnace 12, collects the constituents of combustion (both from the pilot light and burner-on operation of the manifold) and vents them externally of the building via a hot gas exhaust flue 36. As with the hot gas exhaust flue 18 from the furnace 12, the flue 36 is connected to the chimney for ultimate venting into the atmosphere. Both the furnace 12 and the hot water heater 14 draw air from the immediately surrounding atmosphere through inlets 31 and 33, respectively, to support pilot light combustion.

The inventive flue gas heat recovery apparatus or system 10 includes a first, or gas-to-liquid type, heat exchanger indicated generally at 38 which is disposed within a thermally insulated cabinet 40 or other suitable structure which also encases a portion of the flues 18 and 36. The system 10 also includes a second, or liquid-to-gas type, heat exchanger indicated generally at 42 which is disposed within the cold air return duct 22 where it transitions into the blower chamber 24. The heat exchangers 38 and 42 are circuitiously fluidically interconnected by a series of water carrying conduits 44*a* through 44*c* which operate to circulate water therebetween under the influence of a series connected pump 46. Although the pump 46 is illustrated as being distinct from the motor 28, it is contemplated that, as an optional embodiment, the motor 28 could be integrated with, and directly mechanically drive the pump 46.

The conduit 44*a* interconnects the input port of pump 46 with an outlet port 38*a* of the heat exchanger 38 where it emerges from the cabinet 40. Another conduit 44*b* interconnects the outlet port of the pump 46 with an inlet port 42*a* of the heat exchanger 42 where it emerges from the cold air return duct 22. The outlet port 42*b* of the heat exchanger 42 is connected to one end of a conduit 44*c* where it emerges from the cold air return duct 22. The other end of the conduit 44*c* is connected to the inlet port 38*b* of the heat exchanger 38 where it emerges from the cabinet 40. The conduits 44*a* through 44*c* are constructed of copper, steel pipe or other suitable material of a small enough diameter to minimize the transit time of fluid flowing therethrough. This minimizes the heat rejection from the fluid through the conduit. Heat loss can also be reduced by the use of insulation around the outer surfaces of conduits, particularly the conduit 44*a* and 44*b* which transports the hottest water and thus has the greatest thermal gradient thereacross.

The cabinet 40 is sealed and inserted serially in line with the hot gas exhaust flues 18 and 36 whereby gas enters the cavity defined by the cabinet 40 from the portion of the flue 18 which interconnects the cabinet 40 with the furnace cabinet 16 and from the portion of the flue 36 which interconnects the cabinet 40 with the hot water heater 14. Baffles or diffusers (not illustrated) are provided within the cabinet 40 to disburse incoming hot exhaust gases received from the furnace 12 and the hot water heater 14 throughout the entire extent of its cavity. The diffusers are sized and positioned so as to prevent straight through flow of the exhaust gases while creating an acceptably low pressure drop across the cabinet 40. Within the cabinet 40, the hot gases swirl about a coil 38*c* of the heat exchanger 38 and impart a substantial portion of their thermal energy thereto. The cooled exhaust gases then pass upwardly through the flues 18 and 36 to be vented via the chimney. In the preferred embodiment of the invention, the flues 18 and 36 are constructed of four inch and six inch steel tubing, respectively, and the cabinet 40 of the heat exchanger 38 is formed of sheet metal of the type used in standard residential ducting systems.

The heat exchangers 38 and 42 are of the type in which relatively extensive lengths of metallic tubing or conduit is shaped in serpentine fashion to form a planar coil and distributed laterally across the extent of a low path of an air duct, gas flue or other gaseous medium. The metal is typically copper, aluminum or other highly thermally conductive material which readily transfers heat between the fluid flowing within the conduit and the air passing outside thereof. Heat transfer is enhanced by the use of aluminum fins on the serpentine coil to greatly increase the outer surface area and thus the heat radiating/absorbing ability thereof. Such structure is well known in the art and the details thereof are deleted here for the sake of brevity.

Likewise, mounting of the heat exchangers in their respective positions will not be detailed herein for the sake of brevity, it being understood that such structure will be obvious to one of ordinary skill in the art in view of the present specification. A filter 48 is provided by conventional mounting means within the cold air return duct 22 upstream of the heat exchanger 42 to remove any foreign matter which enters the duct system within the structure to prevent contamination of the heat exchanger 42 which could otherwise lose efficiency over time. A four inch fresh air intake opening 50 is provided in the cold air return duct 22 to draw atmospheric air therein to make up for any air lost in the combustion process within the furnace 12 or heat distribution network. Although the intake opening 50 is illustrated as communicating with the atmosphere immediately adjacent the cold air return duct 22, make-up air is drawn from outside the heated structure. A damper 52 is mounted to the cold air return duct 22 by a screw 51 or other suitable fastener and operates as a manually operated valving element to control the amount of make-up air drawn through the intake opening 50.

The coils of the heat exchanger 38 and 42 as well as the conduits 44*a* through 44*c* collectively form a closed circuit or loop within which water or other suitable liquid circulates under the influence of pump 46. Because the water flowing within the conduits 44*a* through 44*c* is at an elevated temperature and pressure, a 15 pound per square inch (psi) relief valve 54 is incorporated within the circuit in the conduit 44*c* to provide overflow to a low pressure (atmospheric) drain 55 via a vent tube 56, should the water pressure within the loop exceed that level. Additionally, an expansion tank 58 and an air relief and purge valve 60 are added to the loop at the conduit 44*b*. The expansion tank operates to absorb mechanical shock due to abrupt starting and stopping of the mass of fluid within the loop when the pump 46 is energized and deenergized as well as providing additional volume when needed due to thermal expansion of the water. The air relief and purge valve 60 operates to remove any air which may inadvertently enter the fluid circulating within the loop. Finally, a source of make-up water 62 is connected to the conduit 44*c* via a manually operated valve 64 to make up for any water in the loop which may be lost due to leakage, evaporation or the like.

Control of the system 10 is effected by the use of a fluid temperature thermostat 66 mounted within the cabinet 40 enclosing the heat exchanger 38. The thermostat 66 is positioned to sense the temperature of the hot exhaust gases within the cabinet 40 and to feed electrical signals to a control circuit 70 via a conductor 71. An additional, optional thermostat 67 consisting of a transducer can be provided to sense the temperature of the air within the cold air return duct 22 if such a parametric input is desired. A pressure transducer 68 and thermometer 69 mounted within the conduit 44*b* provide local visual indication of the systems operation. The control circuit 70 is connected to a source of electrical household current (not illustrated) and operates to energize the pump 46 via an electrical line 72 when the sensed fluid temperature of the exhaust gases within the cabinet 40 enclosing the heat exchanger 38 reaches 100 degrees Fahrenheit and to subsequently switch the pump 46 off when the fluid temperature of the exhaust gases falls below 80 degrees Fahrenheit The specified temperatures were those which were experimentally found by the applicant to produce acceptable results for a specific structure being heated and thus are included here only to be by way of an example. The control circuit 70 is also electrically connected to a relay 74 which is electrically disposed intermediate switch 30 and the blower motor 28 to override operation thereof by directly energizing the blower motor 28 whenever the pump 46 is also energized for purposes which will become apparent herein below.

Finally, a four inch tubular metal bypass or discharge flue pipe 76 interconnects a point upstream with a point downstream of the cabinet 40 within the hot gas exhaust flue 36 and includes several manually operated dampers 78 which allow for bypass of the heat exchanger 38 during summer use by opening the dampers 78 within the bypass pipe 76 and closing the damper 78 within the hot gas exhaust flue 36.

The system 10 operates as follows:

When energized by a control signal on the line 72, the pump 46 circulates fluid circuitiously through the conduits 44, and the heat exchangers 38 and 42 at a nominal 14 pounds of pressure. The control circuit 70 operates purely as a function of the sensed temperature within the heat exchanger 38 and is thus independent of furnace operation. Whenever enough heat cumulatively passes through exhaust flues 18 and 36, sufficient to raise the temperature of gases within the cabinet 40 above 100 degrees Fahrenheit, the control circuit 70 will receive a first signal from the thermostat 66 via the line 71. The control circuit 70 then simultaneously energizes the pump 46 via the line 72 and the motor 28 via the relay 74 to cause the water within the loop to be circulated and to effect a net heat transfer from the heat exchanger 38 to the heat exchanger 42. Because the motor 28 is energized, air will be circulating through the furnace irrespective of normal sequencing of furnace operation. Therefore, cool air will be drawn into the cold air return duct 22 and past heat exchanger 42 which, because it is relatively warm with respect to the returning cold air, will impart heat to the air prior to its entering the furnace 12. By reducing the difference in temperature between returning cold air and the hot air emitted from the furnace 12, into the hot air duct 20, more efficient operation can be achieved whereby the heat which otherwise would be lost from the building via the flues 36 and 18 is transmitted to the water within the loop and ultimately imparted to the air in the cold air return duct 22.

The pump 46 and the motor 28 will remain energized until the temperature of the exhaust gases within the cabinet 40 falls below 80 degrees Fahrenheit, at which time a second signal is received from the thermostat 66 via the line 71, and the pump 46 will cease to operate and the motor 28 will be returned to the control of switch 30 for normal furnace operation and sequencing.

The effectiveness of combining appliances (the furnace 12 and the hot water heater 16) is evidenced by observations by the Applicant that, in one installation, the net effect of adding the hot water heater alone was to increase the outlet air temperature of the furnace 12 by 5 degrees.

The present inventive flue gas heat recovery apparatus is relatively simple to operate and maintain and is constructed entirely of commercially available materials. The actual circuit of the control 70 and its associated transducers and relays was not given in detail inasmuch as any number of different circuits can perform the same function as now should be obvious to one of ordinary skill in the art.

Restated, the theory of operation of the system 10 is this. Heat is absorbed from the hot gases in the flues 18 and 36 and transferred to fluid flowing through the heat exchanger 38. The heated liquid is circulated through a closed loop to a second heat exchanger 42 within the cold air return duct 22 which expels the heat to the fresh air entering the furnace 12 to reduce the furnace air in/out temperature differential. This effects a net heat transfer to the cold air return duct.

The heat exchanging water is circulated through a closed loop by the pump 46 which is energized via a control signal by the control circuit 70. The control circuit 70 is hysteretic in that it does not turn the pump 46 on until the exhaust gas temperature equals 100 degrees Fahrenheit (the upper or high temperature set point) and does not turn it off until the exhaust gas water temperature equals 80 degress Fahrenheit (the lower or low temperature set point). This effect can be achieved by the thermostat 66 consisting of a single fluid temperature transducer having two discrete independent set points or two distinct separately calibrated transducers. More sophisticated control could be employed through the use of a microprocessor control and the optional thermostat 67.

In an alternative embodiment of the invention, thermostat 66 can be optional and the control circuit 70 operates to energize pump 46 as a function of the operation of motor 28 whereby pump 46 will operate whenever motor 28 does.

It is to be understood that the invention has been described with reference to a specific embodiment which provides the features and advantages previously described, and that such specific embodiment is susceptible of modification as will be apparent to those skilled in the art. For example, the specified materials or the temperature limits specified in the preferred embodiment for actuation of the control circuit can be readily altered to suit another application. Accordingly, the foregoing description is not to be construed in a limiting sense.

What is claimed is:

1. A flue gas heat recovery apparatus for use with a forced air type furnace including a blower, first blower control means for selective operation of said blower, an exhaust flue and a cold air return duct, said apparatus comprising:

a gas to liquid heat exchanger mounted in said flue and operative to absorb exhaust gas heat from within said flue;

a liquid to gas heat exchanger mounted in said cold air return duct in fluid communication with said gas to liquid heat exchanger and operative to expend said absorbed exhaust gas heat within said cold air return duct;

pump means interposed between said gas to liquid heat exhanger and liquid to gas heat exchanger operative to circulate a liquid between said heat exchangers in response to a control signal to effect a net heat transfer from the gas within said flue to the air within said cold air return duct; said heat exchangers and pump means being connected in series for fluid communication in a closed loop;

second blower control means operative to monitor the temperature of said exhaust gas and generate said control signal as a function of said temperature and preselected temperature level limits, said second blower control means further comprising means for temporarily overriding the first blower control means during generation of said control signal such that the blower of the forced air furnace operates continuously when said exhaust gas temperature exceeds one of said temperature level limits; and air relief and purge valve means mounted in said closed loop operative to remove any air which may inadvertently enter said closed loop.

2. The apparatus of claim 1, wherein said gas to liquid heat exchanger is further operative to absorb exhaust gas heat from a hot water heater exhaust flue.

3. The apparatus of claim 2, further comprising duct means operable to selectively reconfigure the exhaust flue associated with said hot water heater to bypass said gas-to-liquid heat exchanger.

4. The apparatus of claim 1, wherein said loop further comprises a pressure relief valve operative to selectively open said loop to a low pressure drain when said liquid exceeds a prestablished pressure limit.

5. The apparatus of claim 1, wherein said loop further comprises a source of make up liquid and a valve operable for selective communication with said loop.

6. The apparatus of claim 1, wherein said loop further comprises an expansion tank operative to receive and discharge liquid from and to said loop as a function of fluid temperature.

7. The apparatus of claim 1, wherein said preselected temperature level limits comprise a high temperature set point and a low temperature set point, and said second blower control means operates to begin generation of said control signal when the temperature of said liquid substantially equals said high temperature set point.

8. The apparatus of claim 7, wherein said high and low temperature set points are one hundred degrees Fahrenheit and eighty degrees Fahrenheit, respectively.

9. The apparatus of claim 7, wherein said second blower control means continues generation of said control signal until said exhaust gas temperature substantially equals said low temperature set point, whereby a hysteretic on-off control function is achieved for said pump means.

* * * * *

UNITED STATES PATENT AND TRADEMARK OFFICE

CERTIFICATE OF CORRECTION

PATENT NO. : 4,401,261

DATED : Aug. 30, 1983

INVENTOR(S) : LeeRoy W. Brown

It is certified that error appears in the above-identified patent and that said Letters Patent is hereby corrected as shown below:

Column 2, Line 37, change "cool return air" to ---- cool air return ----.

Column 3, Line 36, change "and" to ---- an ----.

Column 5, Line 62, after "gas" delete the hyphen ---- - ----.

Same line, after "to" delete the hyphen ---- - ----.

Column 5, Line 66, after "liquid" delete the hyphen ---- - ----.

Column 5, Line 67, after "to" delete the hyphen ---- - ----.

Column 6, Line 26, after "of" insert ---- the ----.

Column 6, line 27, delete "conduit" and insert ---- conduits ----.

Column 7, Line 24, after "of" first occurrence, insert ---- the ----.

UNITED STATES PATENT AND TRADEMARK OFFICE

CERTIFICATE OF CORRECTION

PATENT NO. : 4,401,261

DATED : Aug. 30, 1983

INVENTOR(S) : LeeRoy W. Brown

It is certified that error appears in the above-identified patent and that said Letters Patent is hereby corrected as shown below:

Column 7, Line 64, after "Fahrenheit" insert a period ---- . ----.

Column 8, Line 23, before "exhaust" insert ---- the ----.

Column 8, Line 41, before "more" insert ---- a ----.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*